United States Patent [19]

Allsop et al.

[11] 3,958,695

[45] May 25, 1976

[54] SHOE MERCHANDIZING AND HANDLING APPARATUS

[76] Inventors: Ivor J. Allsop; Jon I. Allsop; Michael G. Allsop; James D. Allsop, all of Box 23, Bellingham, Wash. 98225

[22] Filed: Jan. 31, 1975

[21] Appl. No.: 546,117

Related U.S. Application Data

[63] Continuation-in-part of Ser. No. 355,698, April 30, 1973, Pat. No. 3,870,153.

[52] U.S. Cl. ..... 211/37; 248/415

[51] Int. Cl.[2] ..... A47F 7/08

[58] Field of Search ..... 211/35, 37, 70; 248/243, 244, 246, 415, 416, 417, 418, 425; 108/139

[56] References Cited

UNITED STATES PATENTS

| | | | |
|---|---|---|---|
| 18,722 | 11/1857 | Mott et al. | 108/139 |
| 459,592 | 9/1891 | Pearce | 108/139 |
| 1,055,201 | 3/1913 | Mason | 248/244 |
| 1,567,038 | 12/1925 | Cavanna | 211/35 X |
| 2,362,746 | 11/1944 | De Vries | 248/415 X |
| 2,673,650 | 3/1954 | Olson | 211/35 |
| 2,674,431 | 4/1954 | Attwood | 248/243 |
| 3,425,564 | 2/1969 | Allsop | 211/37 |
| 3,478,890 | 11/1969 | Allsop | 211/37 |
| 3,730,468 | 5/1973 | Magnusen | 248/246 |
| 3,870,153 | 3/1975 | Allsop | 211/37 |

FOREIGN PATENTS OR APPLICATIONS

| | | | |
|---|---|---|---|
| 1,303,172 | 7/1962 | France | 248/226 |

*Primary Examiner*—William H. Schultz
*Attorney, Agent, or Firm*—Sherman Levy

[57] ABSTRACT

A shoe merchandizing and handling apparatus is provided that in one form consists of a rotatable rack that has a plurality of supports connected thereto whereby various types of boots, shoes and the like can be suitably supported thereon. In another form, a portion of the device can be attached to a wall to provide a support for a plurality of shoes, boots or the like.

2 Claims, 6 Drawing Figures

249
248
224
223
225
226
222
4
31
224
4
224
222
225
226
210
31
210
200
224
233
209
216
206
204
54
207
226
227
49
250
228
205
31
203
224
215
214
211
212
213
201

SHOE MERCHANDIZING AND HANDLING APPARATUS

CROSS REFERENCE TO RELATED APPLICATIONS

The present application is a continuation-in-part of prior patent application Ser. No. 355,698, filed Apr. 30, 1973, now U.S. Pat. No. 3,870,153.

FIELD OF THE INVENTION

The present invention relates to racks or supports for shoes, boots and the like.

SUMMARY OF THE INVENTION

A shoe merchandizing and handling apparatus is provided that in one form of the invention consists of a rotatable rack that permits a plurality of shoes, boots and the like to be conveniently supported therein so as to facilitate the merchandizing thereof. In another form of the device, holders can be suitably fastened to a vertical wall whereby shoes or boots can be supported in the desired manner.

A primary object of the present invention is to provide a shoe merchandizing and handling apparatus that is efficient to use and especially convenient for use in retail stores or other establishments, and wherein a plurality of shoes, boots and the like can be conveniently supported to facilitate the merchandizing or sale of such shoes, boots or the like in various locations.

A still further object of the present invention is to provide a shoe merchandizing and handling apparatus that is ruggedly constructed and relatively simple and inexpensive to install and manufacture and which is efficient in use.

Other objects and advantages will become apparent in the following specification when considered in the light of the attached drawings.

BRIEF DESCRIPTION OF THE DRAWINGS

Figure 1:
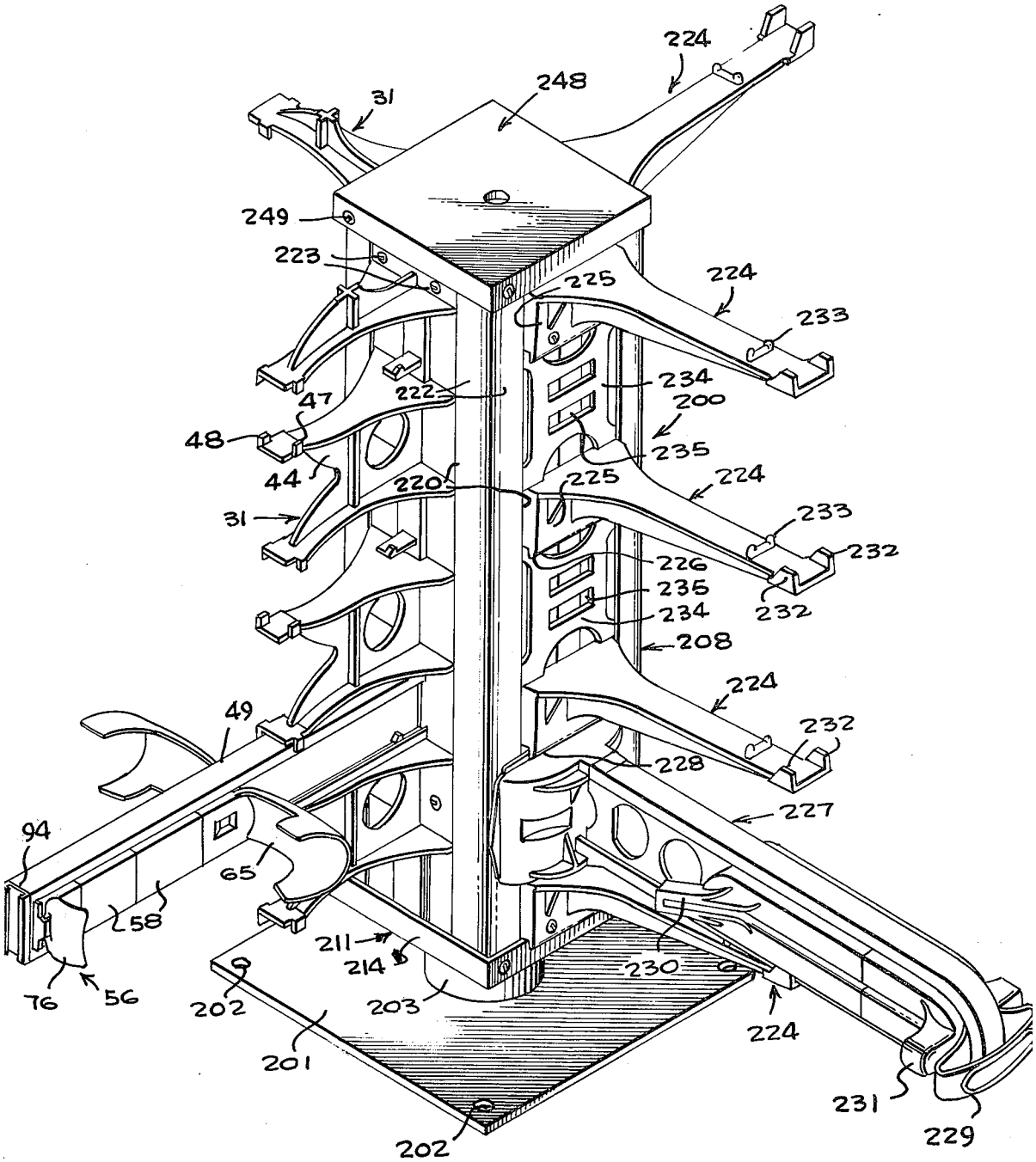
FIG. 1 is a perspective view of a shoe merchandizing stand with two different types of shoe holding clamps illustrated thereon.
Figure 2:
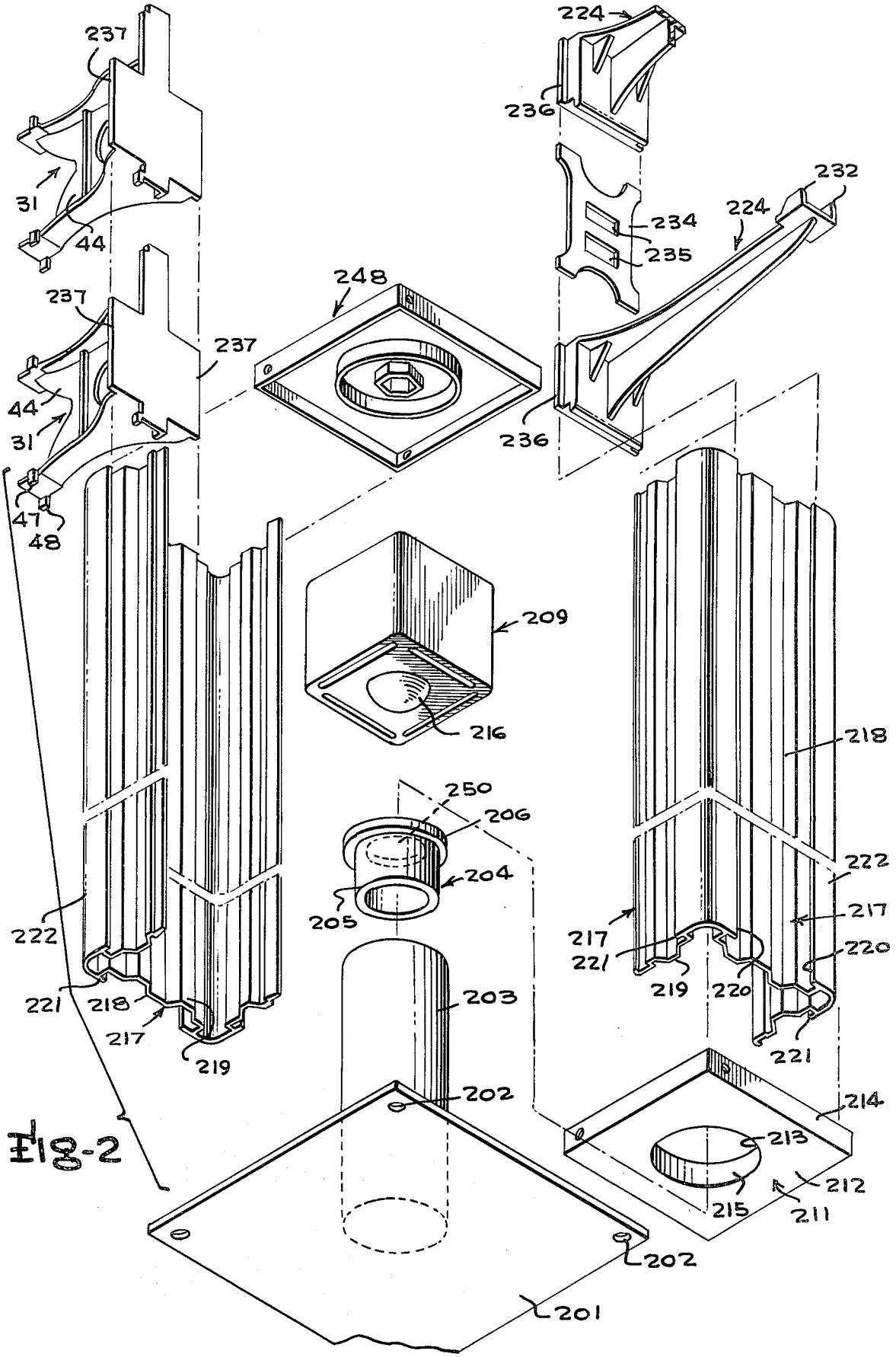
FIG. 2 is an exploded perspective view of the stand of FIG. 1 and showing the parts separated for clarity of illustration.
Figure 3:
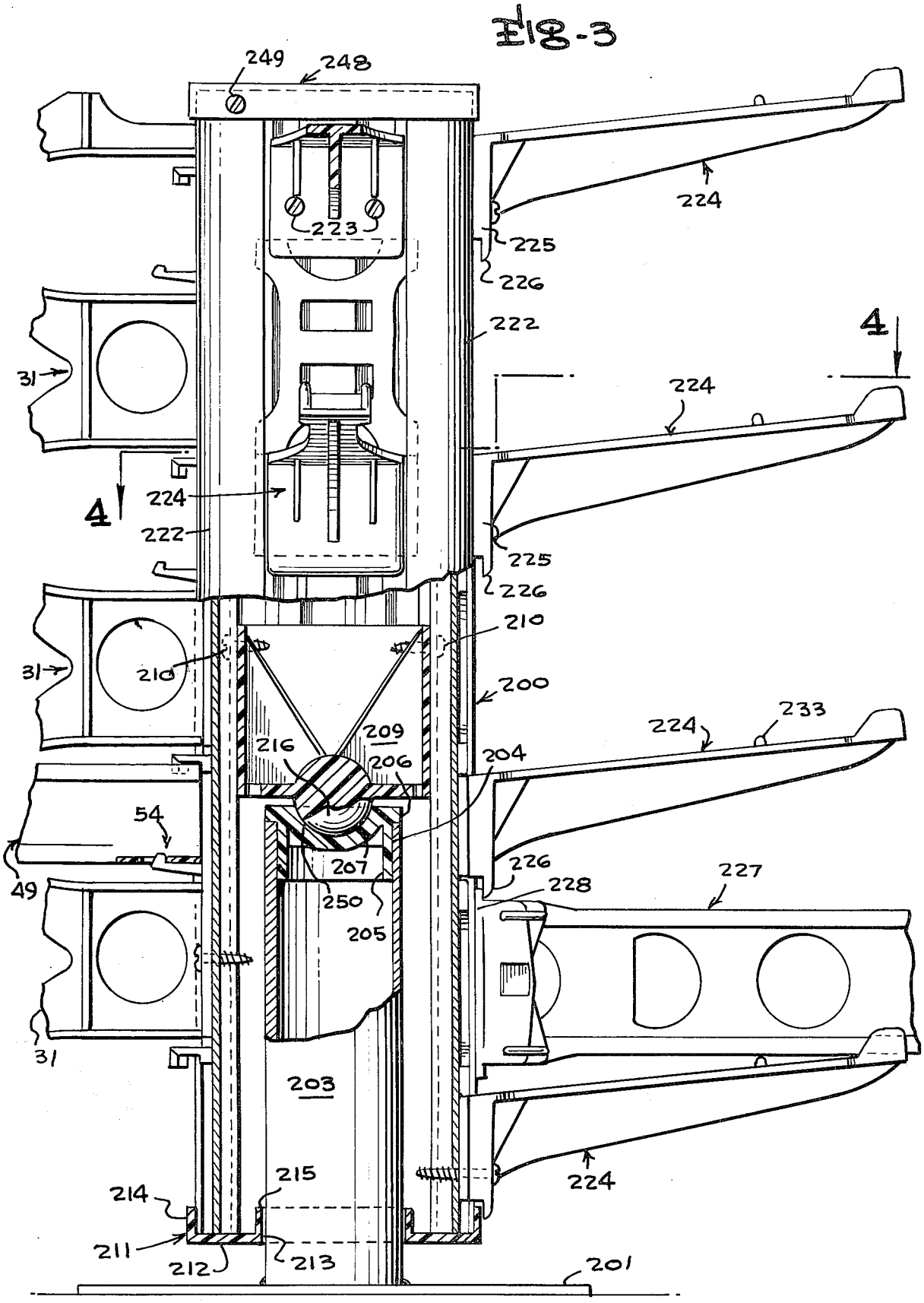
FIG. 3 is a front elevational view of the stand with parts broken away to show the interior structure.

Referring now to the drawings in detail, and more particularly to FIGS. 1, 2, 3 and 4 of the drawings, the numeral 200 indicates the shoe merchandizing and handling apparatus of the present invention that is shown to comprise a horizontally disposed base 201 that has openings or apertures 202 therein, FIG. 1, whereby suitably securing elements such as screws, nails, and the like can be inserted through the openings 202 in order to mount or connect the base 201 to a floor in a store or other establishment or locality. As shown in FIG. 2, a vertically disposed post 203 is secured to or formed integral with the stationary base 201, and the numeral 204 indicates a support piece that is mounted on the upper end of the post 203. The support piece 204 includes a reduced diameter section 205 that is snuggly received in the upper open end of the post 203, and the support piece 204 includes an annular flange 26 as well as a top portion 207. As shown in FIG. 3, the top portion 207 has a recessed surface or curved indentation 250 for a purpose to be later described.

The numeral 209 indicates a body piece that is mounted in a rotary hollow column 208, and the body piece 209 is suitably secured within the rotary column 208 as, for example, by means of securing elements or screws 210, FIG. 3. Depending from the lower surface of the body piece 209 and formed integral therewith is a curved ball member 216 that has a rotary fit in the recessed seat 250, whereby the column 208 can rotate about a vertical axis extending through the post 203.

The number 211 indicates a bottom piece that is suitably mounted on the lower end of the column 208, and the bottom piece 211 includes a lower flat section 212 that has a circular opening 213 therein for the projection therethrough of the post 203. The bottom piece 211 is provided with outer and inner upstanding flanges 214 and 215 that are arranged in spaced relation with respect to each other.

The hollow column 208 includes side portions 217 that each include a generally flat intermediate section 218 as well as inwardly offset grooved portion 219. Diametrically opposed flanges 220 are provided on each of the side sections 217, and the flanges 220 coact with the adjacent portions to define elongated channels or grooves 221 for a purpose to be later described. The column further includes rounded or curved corner portions 222, FIGS. 1 and 4.

As shown in FIG. 1, brackets 31 are adapted to be arranged in superimposed relation with respect to each other on certain of the sides 217 of the column 208, and the brackets 31 have a construction generally similar to the brackets 31 shown and described in detail in prior U.S. patent application Ser. No. 355,698, filed Apr. 30, 1973. The brackets 31 may be held in place by securing elements such as screws 223 which are connected to the rotary column 208. The brackets 31 include webs 44 as well as spaced apart lugs 47 and 48 on the outer portions thereof. A body member or bar 49 is adapted to be mounted between each pair of brackets 31 as shown in FIG. 1. Also, a locking means is provided for retaining the bar 49 in place between the brackets 31, and this locking means is indicated by the numeral 54 in FIG. 3. The shoe holding or article holding means 56 are provided whereby shoes can be conveniently merchandized and displayed or stored in a highly advantageous manner, and the shoe holding means 56 includes a pair of similar base elements 58 as well as a heel piece 65 and a toe piece 76. An end piece 94 is releasably mounted on the outer end of each bar 49 and the end piece 94 is adapted to provide a convenient means for supporting an indicia tab thereon whereby certain information such as price information as well as sizes of shoes being merchandized or other information such as refill information for use of store personnel can be readily provided.

Figure 4:
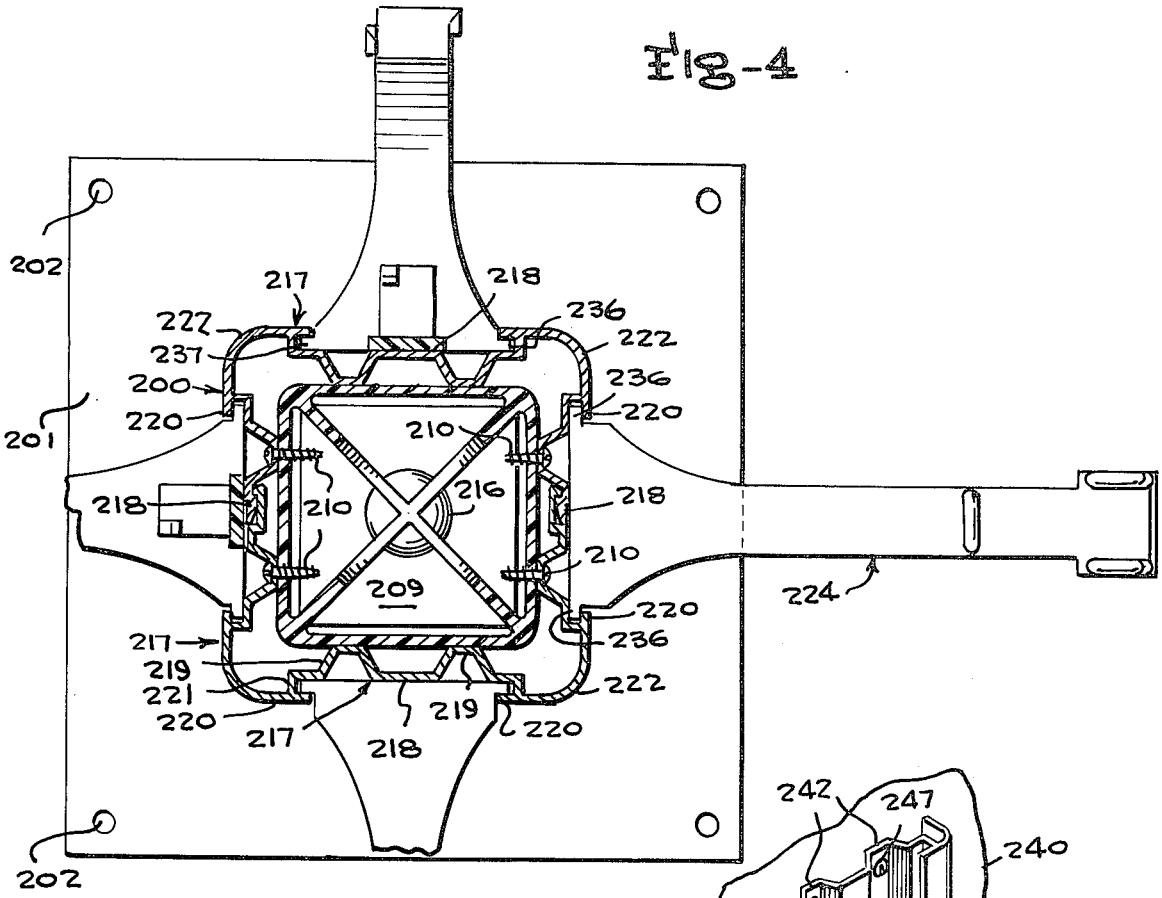
FIG. 4 is a sectional view taken through the stand and taken on the line 4—4 of FIG. 3.

In addition to the brackets 31 and shoe holding means 49, other types of shoe or boot or skate holders such as the holders 227 can be conveniently supported on the apparatus of the present invention. Thus, as shown in FIG. 1, brackets 224 have base portions 225 that are provided with outwardly disposed flanges 236 that are snuggly engaged within the channels 221. Similarly, the brackets 31 have flanges 237 that are adapted to be snuggly received in other of the channels 221 as shown in FIG. 4.

The brackets 224 have a construction and function generally similar to those shown and described in prior U.S. Pat. No. 3,425,564, and the brackets 224 include inwardly disposed base portions 225 that have offset shoulders or lugs 226. The numeral 227 indicates ice skate holders or the like that have base portions 228 that are provided with a lip that is adapted to snuggly engage and co-act with the flange 226 whereby the article holders 227 can be conveniently locked in place between the brackets 224. The holders 227 have handles 229 on the outer ends thereof, and the holders 227 may be provided with string pressed heel and toe portions 230 and 231. The brackets 224 have on their outer ends lugs 232 that are spaced outwardly from a cross piece 233.

The numeral 234 indicates spacers that are interposed between certain of the brackets 224, and the spacers 234 have slots or cut-away portions 235 therein.

It is to be understood that while FIG. 1 illustrates ice skate holders 227 being supported in the device and that other types of members such as automatic boot and shoe trees similar to those shown in prior U.S. Pat. No. 3,210,787 may be supported therein.

Figure 6:
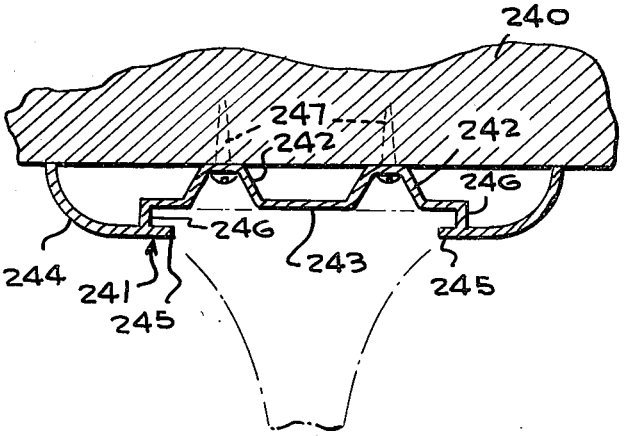
FIG. 6 is a sectional view taken on the line 6—6 of FIG. 5.
Figure 5:
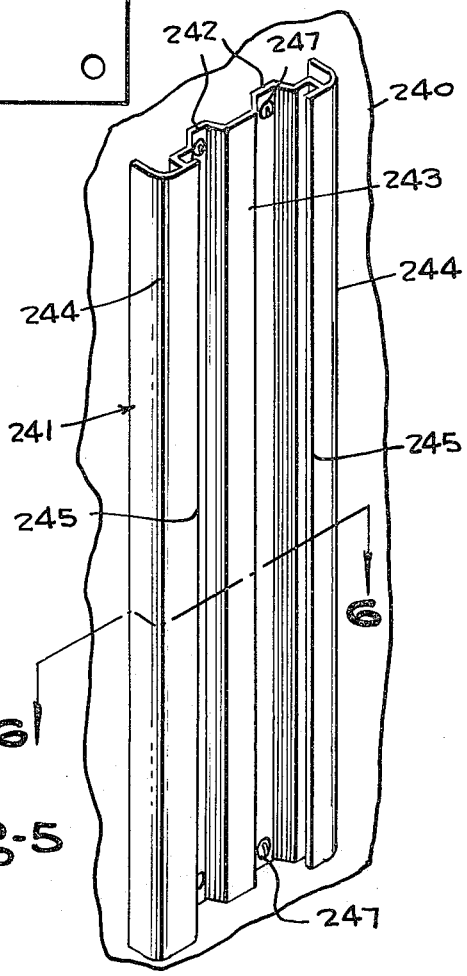
FIG. 5 is a perspective view of a modification showing a wall attachable holder.

Attention is now directed to FIGS. 5 and 6 of the drawings wherein there is illustrated a modified or alternative construction wherein the numeral 241 indicates a support section that is adapted to be fastened to a stationary wall member 240, and the section 241 includes inwardly offset grooved portions 242 as well as an intermediate generally flat section or portion 243. The section 241 is further provided with rounded or curved edges or corners 244. Diametrically opposed flanges 245 are provided on the section 241, whereby there is defined in the section 241 channels or grooves 246 that have a construction or purpose generally similar to the previously described channels 237 for receiving flanges on certain of the brackets.

The numeral 248 indicates a top piece that is mounted on the column 208, and the top piece 248 is held in place by securing elements such as screws 249.

From the foregoing, it will be seen that there has been provided a shoe merchandizing and handling apparatus, and in use with the parts arranged as shown in FIGS. 1–4, the apparatus or rack 200 of the present invention can be arranged in a suitable location such as in a shoe store, department store or other locality, ski shop or other locality. The base 201 can be connected to the floor by means of securing elements such as screws that can be extended through the openings 202. The base 201 has the post 203 secured thereto as by welding. Mounted on the upper end of the post 203 is the support piece 204 that has the recessed indentation 250 therein. The body piece 209 has the depending ball shaped member 206 which rotatably engages the recess 250. The body piece 209 is fastened within the hollow rotary column 208 by means of the screws 210. This construction provides a ball bearing type of arrangement whereby the column 208 can rotate about an axis extending through the post 203. Thus, by means of this rotation, any of the shoe holding members 56 or 227 can be conveniently and readily rotated or moved to a position that is convenient to the user or purchaser in the store or other locality.

Various types of shoe holding brackets can be connected to the column 208. For example, a plurality of the brackets 31 can be connected to the column as shown in the drawings, and the brackets 31 can provide a means for detachably supporting article holding members 49 and 56 whereby a plurality of different shoes of different types and sizes can be conveniently supported in the units 56. These co-acting brackets 31 and members 49 have a detachable locking means 54 thereon whereby when desired, the members or units 49 can be readily removed from the rack so that a person can use the device in the desired manner. In addition, the members 56 include the heel and toe pieces 65 and 76 that urged towards each other by suitable spring members as shown in detail in prior U.S. patent application Ser. No. 355,698 whereby the shoes can be conveniently releasably supported in these members 56 so that the shoes can be removed or replaced as desired with facility and convenience.

In addition, the column 208 can have a plurality of the brackets 224 connected thereto and wherein spacers 234 are provided between adjacent brackets 224 in order to maintain these parts in their proper spaced apart relation relative to each other. The brackets 224 can be used for supporting therebetween ice skate holders as indicated by the numeral 227 in FIG. 1 or else they can be used for holding other similar devices such as automatic boot or shoe trees of the type shown in prior U.S. Pat. No. 3,210,787. The brackets 224 provide a supporting means whereby units such as the units 227 can be readily removed from or positioned between the brackets 224.

It will be noted that the column 208 has a hollow formation and wherein the column includes four generally similar sides 217 and wherein each of the sides 217 includes inwardly offset grooved portions 219, certain of which provide a means for conveniently receiving screws 210 that serve to fixedly mount the piece 209 in place. The piece 209 includes the ball member 216 that rotatably engages the recess 250.

It will be noted that the sides 217 also include the diametrically opposed flanges 220 that co-act with the adjacent portions of the column to define channels or grooves 221, and these channels 221 snuggly receive therein edge portions or flanges such as the flange portions 236 and 237 of the respective brackets 224 and 31.

In the modified form or alternative form of the invention shown in FIGS. 5 and 6, instead of using a rotary rack or support, a support section 241 is adapted to be connected to a wall such as the vertical wall 240 by means of the screws 247. The section 241 includes curved portions 244 that help brace the device against the wall 240, and these curved portions 244 also prevent a person from accidentally snagging his or her clothing on any sharp edges. The section 241 includes flanges 245 that define channels 246 for receiving therein edge portions of the brackets whereby the brackets can be conveniently held in place in the channels 46.

It is to be understood that the parts can be made of any suitable material and in different shapes and sizes as desired or required.

It will be seen that the shoe merchandizing system or apparatus of the present invention includes a column with a sliding construction as well as an improved bearing arrangement. Certain of the parts can be made of material such as aluminum and plastic. The brackets co-act with the column and have a means whereby the brackets can slide in place. The bearing parts 216 and 250 can be made of a suitable material such as nylon, and all of the work or force is in the center in the vicinity of the ball 216 and recess 250 whereby a highly efficient rotary support means is provided. This is important because a completely assembled rack has a considerable amount of weight, and this arrangement assures that the rotation can take place regardless of the weight being supported.

Also, the rack includes the aluminum center column that has parts that can snap together as shown in FIG. 2 so that a four sided column can be provided. This will help facilitate the job of assembling the device since the parts can be readily be snapped together for easy assembly.

FIGS. 5 and 6 indicate a wall rack extrusion type of unit wherein the unit such as the unit 241 can be extruded aluminum having the proper configuration to receive the flanges 236 or 237 of the brackets in order to hold the parts in place.

The device is especially suitable for use in holding shoes and wherein the shoe supports can use rubber bands and not springs. The parts can be made of a convenient material such as plastic and the like.

With regard to the members 56, the heel cups can hold the uppers of the shoes instead of the soles so that various types of foot wear such as foot wear having molded soles can be supported. Further, the heel and toe cups can be reversed and the mechanism for snapping in and out and exchanging one for the other is advantageous since this allows the device to be used toe in or toe out, depending upon whether the shoe is a high top shoe or a low top shoe. The device has an improved snap-in, snap-out construction. Also, certain of the components such as the members 56 or 227 can be used as carriers for the shoes when these devices are removed from the racks. The shoes or footwear can be held in any position even upside down.

Additional embodiments of the invention in this specification will occur to others and, therefore, it is intended that the scope of the invention be limited only by the appended claims and not by the embodiments described hereinabove. Accordingly, reference should be made to the following claims in determining the full scope of the invention.

What is claimed is:

1. As a new article of manufacture, a shoe merchandizing and handling apparatus comprising a horizontally disposed base, a vertically disposed post secured to said base and extending upwardly therefrom, a support piece mounted on the upper end of said post and said support piece including a reduced diameter section that is snugly received in the upper end of said post, said support piece including an annular flange as well as a top portion, said top portion having a recessed surface, a vertically disposed rotary hollow column having a body piece securely mounted therein, a ball depending from the lower surface of said body piece and said ball having a rotary fit in said recessed surface whereby the column can rotate about a vertical axis extending through the post, a bottom piece mounted on the lower end of said column and said bottom piece including a lower flat section that has a circular opening therein for the projection therethrough of said post, said bottom piece being provided with outer and inner upstanding flanges that are arranged in spaced relation with respect to each other, said column including side portions having flanges thereon defining channels, and said side portions including intermediate generally flat sections, superimposed brackets having base portions mounted in the channels on certain of the sides of said column, and said column including curved corner sections, and bars detachably mounted between certain of said brackets, and shoe holding members on said bars.

2. The structure as defined in claim 1 and further including spacers interposed between certain of said brackets, and said spacers having slots therein.

* * * * *